United States Patent [19]

Anand et al.

[11] Patent Number: 4,925,626

[45] Date of Patent: May 15, 1990

[54] METHOD FOR PRODUCING A WC-CO-CR ALLOY SUITABLE FOR USE AS A HARD NON-CORROSIVE COATING

[76] Inventors: Vidhu Anand, 120 Vista Dr., Apt. 5, Sayre, Pa. 18840; David L. Houck, 5 Mix Ave., Towanda, Pa. 18848

[21] Appl. No.: 337,678

[22] Filed: Apr. 13, 1989

[51] Int. Cl.[5] ..... B22F 1/00

[52] U.S. Cl. ..... 419/18; 75/240; 419/23

[58] Field of Search ..... 75/240; 419/18, 23

[56] References Cited

U.S. PATENT DOCUMENTS

| | | | |
|---|---|---|---|
| 4,576,642 | 3/1986 | Holtz | 75/240 |
| 4,589,917 | 5/1986 | Nagato | 75/240 |
| 4,810,289 | 3/1989 | Hoyen et al. | 75/240 |

*Primary Examiner*—Stephen J. Lechert, Jr.

[57] ABSTRACT

A method is disclosed for producing a Wc-Co-Cr alloy which comprises alloying a mixture consisting essentially of in percent by weight of from about 85 to about 90 tungsten carbide, wherein the particle size of the tungsten carbide is less than about 1 micrometer in diameter, from about 9 to about 11 cobalt metal powder, wherein the particle size of the cobalt is from about 1 to about 5 micrometers in diameter, and from about 3.5 to about 4.5 chromium wherein the chromium is provided as chromium carbide to produce a Wc-Co-Cr alloy the alloy capable of being used as a coating wherein the hardness of the coating is from about 1060 to about 1240 DPH carbide hardness and from about 870 to about 980 DPH matrix hardness and wherein the roughness is from about 190 to about 200 AA.

1 Claim, No Drawings

METHOD FOR PRODUCING A WC-CO-CR ALLOY SUITABLE FOR USE AS A HARD NON-CORROSIVE COATING

BACKGROUND OF THE INVENTION

This invention relates to a method for producing a WC-Co-Cr alloy suitable for use as a hard non-corrosive alloy. The method involves use of submicron tungsten carbide and the use of chromium carbide as the source of chromium.

Wc-Co-Cr coatings have been commercially used for several years in highly corrosive and wear environments. These alloys contain typically 8–10 by weight cobalt, 3–4% by weight chromium, 4.5–5.5% by weight carbon and the balance being tungsten. Some of the newer alloys of this type such as those described in U.S. Pat. Nos. 4,626,476 and 4,588,608 contain combinations of 4–18% by weight cobalt, 2–11.5% by weight chromium, and 3.5% by weight carbon. These alloys have been developed with the idea of improving coating toughness and its resistance to high residual stresses (resulting from thermal expansion mismatch). However there is still an increasng demand for coatings with better internal strength and wear characteristics without sacrificing corrosion. It has become more desirable also to have smoother "as sprayed" deposits which require minimal finishing.

Coatings of WC-Co-Cr alloys derive their acclaimed properties from chemistry control and by controlling the spraying method. For instance it is widely accepted in the industry that Detonation gun (D-gun) deposits are significantly superior than the conventional and the high velocity plasma sprayed deposits for "hard coatings" (carbide based). It is well known also that coating strength is determined by the amount of carbide in the alloy. The greater the amount of WC, the stronger is the coating, provided it can be held together by a matrix. Cobalt has been traditionally developed as an ideal matrix material for WC-based alloys. As cobalt content is increased, the coating toughness increases proportionately. Chromium contributes towards improved corrosion. It also combines with W and C to improve wear performance by forming complex Cr-W-C carbides.

SUMMARY OF THE INVENTION

In accordance with one aspect of the invention, there is provided a method for producing a WC-Co-Cr alloy suitable for use as a coating which comprises alloying a mixture consisting essentially of in percent by weight of from about 85 to about 90 tungsten carbide, wherein the particle size of the tungsten carbide is less than about 1 micrometer in diameter, from about 9 to about 11 cobalt metal powder, wherein the particle size of the cobalt is from about 1 to about 5 micrometers in diameter, and from about 3.5 to about 4.5 chromium wherein the chromium is provided as chromium carbide, to produce a Wc-Co-Cr alloy the alloy capable of being used as a coating wherein the hardness of the coating is from about 1060 to about 1240 DPH carbide hardness and from about 870 to about 980 DPH matrix hardness and wherein the roughness is from about 190 to about 200 AA.

DETAILED DESCRIPTION OF THE INVENTION

For a better understanding of the present invention, together with other and further objects, advantages, and capabilities thereof, reference is made to the following disclosure and appended claims in connection with the above description of some of the aspects of the invention.

This invention is based on controlling the particle size and morphology of carbides in addition to chemistry control in the formation of WC-Co-Cr alloys. The use of submicron (micrograin) starting tungsten carbide and addition of chromium as chromium carbide ($Cr_3C_2$) significantly improves wear characteristics of coatings of WC-Co-Cr alloys.

Conventional WC-Co alloys in general and WC-Co-Cr alloys in particular utilize 1–20 micrometer starting carbides. Fine carbides (1–3 micrometer) are used when designing highly wear resistant materials. It has been found that use of submicron tungsten carbide, that is tungsten carbide having a particle size of less than about 1 micrometer in diameter results in improved hardness and wear resistance when the alloy is used as a coating for a substrate. The most typical substrates that are coated with the alloy of the present invention are stainless steel and titanium based alloys such as those used in aerospace applications. The tight size control renders microstructural uniformity. In addition the smoothness of the coating is improved.

Conventional WC-Co-Cr alloys use elemental Cr which imparts corrosion resistance to the matrix. Some of the chromium also forms complex Cr-W-C carbides. Most of the chromium remains in the matrix as a solid solution of chromium. The strengthening due to the solid solution of chromium may not be as high as the strengthening due to the carbides. According to one embodiment of the present invention, the addition of chromium as chromium carbide to the matrix improves matrix hardness as well as improvement in wear performance of the carbide/matrix couple.

To produce the alloy of the present invention, a mixture is formed consisting essentially of in percent by weight from about 85 to about 90 tungsten carbide, from about 9 to about 11 cobalt metal powder and from about 3.5 to about 4.5 chromium.

The tungsten carbide can be essentially any type as long as the particle size is less than about 1 micrometer in mean diameter. The typical particle size is from about 0.7 to about 0.8 micrometers in mean diameter. A preferred source of submicron tungsten carbide is that made according to U.S. Pat. No. 4,664,899.

The chromium is provided in the form of chromium carbide. The particle size of the chromium carbide is typically less than about 20 micrometers in diameter and most preferably less than about 10 micrometers in diameter.

The cobalt is cobalt metal powder having a particle size of from about 1 micrometer to about 5 micrometers in diameter.

The mixture is alloyed by known methods such as by spray drying followed by sintering and then plasma densification. These techniques are described in U.S. Pat. Nos. 3,881,911 and 3,909,241.

The alloy is used as a coating for a substrate as described previously. The coating can be applied by any of the techniques known in the art. One of these techniques is by a hypersonic combustion spraying process.

The coatings made with the alloy of the present invention are higher in hardness, are more wear resistant and are generally smoother than the coatings made with conventional WC-Co-Cr alloys as will be shown in the example that follows.

To more fully illustrate this invention, the following non-limiting example is presented.

EXAMPLE

Several WC-Co-Cr alloys both conventional and of the present invention are used as coatings for stainless steel substrates. The coating properties of the alloys of the present invention are compared with conventional alloys. The alloys are made using spray drying-sintering-plasma densification technology. The starting chemistries and product differences are highlighted in Table I. Alloys 1 and 2 are WC-Co-Cr alloys made by conventional methods using chromium metal as the source of chromium. Alloy 3 is the alloy of the present invention made with chromium carbide as the source of chromium and tungsten carbide having a particle size of less than about 1 micrometer in diameter (micrograin tungsten carbide). The alloys are screened to typically −270 mesh cuts and sprayed using hypersonic equipment using oxypropylene and oxy-hydrogen mixtures. Stoichiometric conditions are used such as a mass flow ratio of 4.5:1 oxygen:fuel wherein the fuel is propylene. Steel panel tests are prepared for hardness evaluation. Microhardness measurements are made on carbide phases and matrix phases. These results are shown in Table II. Wear test results are based on the actual components tested in service in a severe wear and corrosive mode. Table III shows these results.

TABLE I

| Element | Alloy WC-12Co* | Alloy WC-17Co** | WC-Co-Cr 1 | WC-Co-Cr 2 | WC-Co-Cr 3 |
|---|---|---|---|---|---|
| Co | | | 9.37 | 9.06 | 10.0 |
| Cr | | | 3.4 | 3.4 | 4.5 |
| C total | 5.15 | 5.2 | 5.37 | 5.38 | 5.91 |
| C free | ND*** | ND | ND | 0.9 | 1.6 |
| Mean Size of WC (micrometer) | 1–3 | 5–7 | 3–7 | 1–3 | 0.8 |
| Other | | | | | $Cr_3C_2$ |
| ****x-ray phases | WC-S $W_2C$ | WC-S $W_2C$-W | WC-S $W_2C$-W | WC-S $W_2$-W | WC-S $W_2C$-W |

*WC with about 12% by weight cobalt
**WC with about 17% by weight cobalt
***ND indicates not determined
****S indicates a strong x-ray peak W indicates a weak x-ray peak

TABLE II

| | | Alloy WC-12Co | Alloy WC-17Co | WC-CO—Cr 1 | WC-CO—Cr 2 | WC-CO—Cr 3 |
|---|---|---|---|---|---|---|
| Carbide Hardness $DPH_{200}$ gm | Range | | | 857–1283 | 1061–1197 | 1061–1239 |
| | Average | 1100 (Typical) | 1050 (Typical) | 1049 | 1129 | 1179 |
| Matrix Hardness DPH 200 gm | Range | | | 584–857 | 483–833 | 874–975 |
| As sprayed Coating Roughness AA | | 184–303 | | 200–225 | 195–220 | 190–200 |

TABLE 2 shows that matrix hardness for the coating of the alloy made by the method of the present invention is higher and more uniform than conventional alloys. The measurements are taken on as-sprayed coatings. A lower roughness number is indicative of a smoother spray surface. Such a coating will typically leave a better surface after grinding.

TABLE III

WEIGHT LOSS AND SURFACE ROUGHNESS OF DEPOSITS AFTER PILOT SCALE TESTING

| | WC-12Co | WC-17Co | WC-Co—Cr 1 | WC-Co—Cr 2 | WC-Co—Cr 3 |
|---|---|---|---|---|---|
| Weight loss | 8× | 7× | 2× | 1.5× | 1× |
| Surface roughness | 12× | 8× | 2× | 1.5× | 1× |

The results show that the coatings made with the alloy of the present invention, Alloy 3, are superior to the conventional alloys, Alloys 1 and 2. The hardness of the coatings made with the alloy of the present invention are from about 1060 to about 1240 DPH carbide hardness. The matrix has a hardness range of about 870 to about 980 DPH. The roughness of the coatings made with the alloy of the present invention as measured by surface profilometry is from about 190 AA to about 200 AA as opposed to the higher values on coatings made with conventional alloys. This indicates that the coatings made with the alloy of the present invention are smoother than the coatings made with conventional alloys. While the actual mechanism for such an improvement is not clearly understood at this time, it is felt that the use of fine carbides of tungsten and chromium reduce matrix contiguity which may contribute to improved overall hardness and wear properties.

The results of TABLE 3 show that the coating made from the alloy produced by the present invention (No. 3) is more resistant to corrosion as indicated by the lower weight loss and better surface finish. Coatings made with conventional methods (Nos. 1 and 2) result in about 1.5 times (1.5 X) to 2 times (2X) more weight loss and surface of the "as sprayed" coatings.

While there has been shown and described what are at present considered the preferred embodiments of the invention, it will be obvious to those skilled in the art that various changes and modifications may be made therein without departing from the scope of the invention as defined by the appended claims.

What is claimed is:

1. A method for producing a WC-Co-Cr suitable for use as a coating, said method comprising alloying a mixture consisting essentially of in percent by weight of from about 85 to about 90 tungsten carbide, wherein the particle size of said tungsten carbide is less than about 1 micrometer in diameter, from about 9 to about 11 percent by weight cobalt metal powder, wherein the particle size of said cobalt is from about 1 to about 5 micrometers in diameter, and from about 3.5 to about 4.5 percent by weight chromium wherein said chromium is provided as chromium carbide to produce a Wc-Co-Cr alloy said alloy capable of being used as a coating wherein the hardness of said coating is from about 1060 to about 1240 DPH carbide hardness and from about 870 to about 980DPH matrix hardness and wherein the roughness is from about 190 to about 200 AA.

* * * * *

UNITED STATES PATENT AND TRADEMARK OFFICE

CERTIFICATE OF CORRECTION

PATENT NO. : 4,925,626

DATED : May 15, 1990

INVENTOR(S) : Vidhu Anand, David L. Houck

It is certified that error appears in the above-identified patent and that said Letters Patent is hereby corrected as shown below:

On the title page, please insert item [73] Assignee:
--GTE Products Corporation, Stamford, Connecticut--.

Signed and Sealed this

Thirtieth Day of June, 1992

*Attest:*

DOUGLAS B. COMER

*Attesting Officer*

*Acting Commissioner of Patents and Trademarks*